US007234261B2

(12) United States Patent
McGarry

(10) Patent No.: US 7,234,261 B2
(45) Date of Patent: Jun. 26, 2007

(54) PISTOL WITH LOCKABLE MANUAL SAFETY MECHANISM

(75) Inventor: James McGarry, Prescott Valley, AZ (US)

(73) Assignee: Sturm, Ruger & Co., Inc., Southport, CT (US)

( * ) Notice: Subject to any disclaimer, the term of this patent is extended or adjusted under 35 U.S.C. 154(b) by 323 days.

(21) Appl. No.: 10/825,510

(22) Filed: Apr. 15, 2004

(65) Prior Publication Data

US 2005/0229461 A1 Oct. 20, 2005

(51) Int. Cl.
*F41A 17/28* (2006.01)

(52) U.S. Cl. ..... 42/70.05; 89/148

(58) Field of Classification Search ..... 42/70.04, 42/70.05; 89/142, 148
See application file for complete search history.

(56) References Cited

U.S. PATENT DOCUMENTS

| | | | | | |
|---|---|---|---|---|---|
| 1,896,820 | A | * | 2/1933 | Jolidon | 89/148 |
| 2,856,718 | A | * | 10/1958 | Fischer | 42/70.05 |
| 4,987,693 | A | | 1/1991 | Brooks | 42/70.11 |
| 5,042,185 | A | | 8/1991 | Justice, Sr. | 42/70.11 |
| 5,081,779 | A | | 1/1992 | Pack | 42/70.11 |
| 5,088,222 | A | | 2/1992 | Larson | 42/70.04 |
| 5,235,763 | A | | 8/1993 | Nosler et al. | 42/70.11 |
| 5,251,394 | A | | 10/1993 | Bornancini | 42/70.05 |
| 5,303,494 | A | * | 4/1994 | Tuma et al. | 42/70.04 |
| 5,402,593 | A | | 4/1995 | Lenkarski et al. | 42/70.06 |
| 5,426,881 | A | | 6/1995 | Ruger | 42/70.08 |
| 5,517,780 | A | | 5/1996 | Haber et al. | 42/70.08 |

(Continued)

FOREIGN PATENT DOCUMENTS

| | | |
|---|---|---|
| DE | 453654 | 12/1997 |

(Continued)

OTHER PUBLICATIONS

Combat Handguns, Jun. 2002, cover and "All About the Glock Lock," pp. 10-13.

(Continued)

*Primary Examiner*—Stephen M. Johnson
(74) *Attorney, Agent, or Firm*—Duane Morris LLP; Frank J. Spanitz

(57) ABSTRACT

A pistol including a mechanism that locks manual safety of the pistol. The lockable manual safety mechanism may include a manual safety that engages the firing apparatus of the pistol to prevent discharge of the pistol when the trigger is pulled. The firing apparatus may include a trigger, trigger bar, sear, and hammer that contacts a firing pin which may strike a chambered cartridge. The manual safety may be movable into and out of engagement with the firing apparatus. In one embodiment, the safety engages the sear to prevent the sear from moving and releasing the hammer while held in the cocked position by the sear. In one embodiment, the manual safety is a lever that is pivotally mounted to the frame of the pistol. The pistol may further include a locking member that engages the safety. The locking member may be movable from an unlocked position in which the manual safety is freely movable, to a locked position engaging the manual safety so that the safety cannot freely move and is locked into engagement with the sear while the hammer is held in the cocked position by the sear. In one embodiment, the locking member may be a lock pin that may be rotatably carried by the pistol.

15 Claims, 12 Drawing Sheets

U.S. PATENT DOCUMENTS

| | | | | |
|---|---|---|---|---|
| 5,570,527 | A | 11/1996 | Felicci | 42/70.08 |
| 5,581,927 | A | 12/1996 | Meller | 42/70.11 |
| 6,173,518 | B1 | 1/2001 | Oberst | 42/70.06 |
| 6,212,812 | B1 | 4/2001 | Aigner | 42/70.06 |
| 6,240,670 | B1 | 6/2001 | Findlay | 42/70.08 |
| 6,256,917 | B1 | 7/2001 | Findlay | 42/70.06 |
| 6,256,918 | B1 | 7/2001 | Szabo | 42/70.08 |
| 6,256,919 | B1 | 7/2001 | Brazeau | 42/70.11 |
| 6,256,920 | B1 | 7/2001 | Olson | 42/70.11 |
| 6,260,298 | B1 | 7/2001 | Bubits | 42/70.08 |
| 6,338,217 | B1 | 1/2002 | Viani | 42/70.08 |
| 6,347,538 | B1 | 2/2002 | Doiron | 70/58 |
| 6,389,728 | B1 | 5/2002 | Lundy | 42/70.11 |
| 6,405,473 | B1 | 6/2002 | Petig et al. | 42/84 |
| 6,418,653 | B1 | 7/2002 | Bowles | 42/66 |
| 6,438,886 | B1 | 8/2002 | Neumann | 42/70.11 |
| 6,463,689 | B1 | 10/2002 | McElroy | 42/70.08 |
| 6,487,804 | B1 | 12/2002 | Petrella, Jr. | 42/70.11 |
| 6,510,639 | B2 | 1/2003 | McMoore | 42/70.06 |
| 6,510,641 | B1 | 1/2003 | Viani | 42/70.08 |
| 6,513,273 | B2 | 2/2003 | da Silveira | 42/70.08 |
| 6,519,888 | B1 | 2/2003 | Oberst | 42/70.11 |
| 6,523,294 | B2 | 2/2003 | Curry et al. | 42/66 |
| 6,550,176 | B2 * | 4/2003 | Beretta | 42/70.11 |
| 2001/0022131 | A1 | 9/2001 | Moczijdlower et al. | 89/155 |
| 2001/0037596 | A1 | 11/2001 | Salvitti | 42/70.08 |
| 2002/0178633 | A1 | 12/2002 | Rollins | 42/70.01 |
| 2002/0194762 | A1 | 12/2002 | Cominolli | 42/70.06 |
| 2003/0145504 | A1 | 8/2003 | Durossette | 42/70.04 |

FOREIGN PATENT DOCUMENTS

| | | |
|---|---|---|
| EP | 1271090 | 1/2003 |

OTHER PUBLICATIONS

Combat Handguns, Aug. 2000, cover and "Gun Safety Roundup," by D.K. Pridgenpp. 64-67.
Combat Handguns, Mar. 2001, p. 91 (showing "keyed internal locking device").
American Rifleman, Jul. 2001, p. 73.
Guns & Ammo. Mar. 2002, p. 70.
Handguns, "Guns & Gear," Oct. 2002, p. 51.
Gun World, Aug. 2003, p. 63-64.
Handguns, Sep. 2001, p. 53.
Combat Handguns, Mar. 2001, Alchemy Arms .45 ACP All-New Spectre, pp. 18-22, 90.
American Rifleman, "Dope Bag Data & Comment," Aug. 2000, p. 62.
Guns Illustrated, 2002, "Gunmaking in the 21st Century," by Bob Hausman, cover and pp. 11-14.
Guns & Weapons for Law Enforcement, "The Guns of Springfield," by Dan Goodwin, pp. 34-36.
Shooting Times, Jan. 2002, "S&W's New Internal Locking System" p. 36.
Guns Illustrated, 2002, 34th Annual Edition, cover, p. 34, and Advertisement: Springfield's Integral Locking System.
Shooting Times, Aug. 2001 p. 60.
Combat Handguns, New Steyr S Series 9 mm), cover & pp. 10-11, no date.
Combat Handguns, Mar. 2002, "New Steyr "M" .357SIG," pp. 48-49.
Women & Guns, "Taurus 'Lock Gun," Mar.-Apr. 1998, pp. 44-45.
Shooting Times, Feb. 1998, pp. 43-44.
Gun World, Apr. 2001, "Springfield Ultra-Compact," pp. 38-41.
American GunSmith, "Springfield Armory's Integral Locking System," Oct. 2001, p. 21.
Shooting Times, Jun. 2001, p. 44.
Handguns, "Firing Line Report-Walter P22," Phil Johnston, May 2002, pp. 50, 52.
AFTE Journal, vol. 26, No. 4, "Passive Safety Lock for Smith & Wesson Pistols," Oct. 1994 pp. 283-285.
Complete Book of Autopistols 2002, pp. 37-38.
Women & Guns, Mar./Apr. 2002, p. 35.
Hand Guns, "Firing Line Report-Taurus PT911," Phil Johnston, Jun. 2001, "Taurus PT911," p. 58.
Combat Handguns, Feb. 2002, "New Taurus PT-145 .45ACP," by Mike Boyle, cover & pp. 40-42.
American Handgunner, "Combat Shooting," Dave Anderson, May/Jun. 2003, p. 34.
Gun Tests, "Smith & Wesson 4566TSW .45 ACP," May 2001, p. 6.
Combat Handguns, Sep. 2002, "Gun Safety & Security," by D.K. Pridgen, cover and pp. 66-69 and 96.
Combat Handguns, Jun. 2001, by D.K. Pridgen, "Safety in New Orleans," cover and pp. 48, 50.
Combat Handguns, Sep. 2003, "Buyers Guide-Gun Safety 2003," pp. 42-45, 88.
Gun World, Apr. 2001, "Bond", pp. 66, 68.
Gun Tests, Shotguns, "Remington 11-87 Premier 20 gauge No. 9591," Oct. 2001, p. 26.
Shooting Sports Retailer, Jan. 2001, pp. 40-42.
Gun World, Feb. 2001 pp. 28-29.
Shooting Times, Jan. 2004, "Remington's .17 HMR Model 597 Magnum—Simplicity, Ruggedness & Practicality," pp. 70-72.
Shooting Illustrated, Apr. 2002, p. 55.
Gun Buyer's Annual 2002, "Remington's M700 VLS .223," p. 14.
The Complete Book of Guns 2002, "New Sako 75 Finnlight .308," p. 6.
Gun World, Oct. 2002, p. 38.
The New Gun Week, "Sako Hunter with Keyed Bolt Unlikely to Disappoint Hunters," Sep. 20, 2003, p. 12.
Guns & Ammo, Jul. 2002, p. 51.
Guns & Ammo Apr. 1970, "Savage's Lockable Guns," p. 38.
The Complete Book of Guns 2002, (S&W revolver internal locking mechanism), p. 47.
Gun World, "Magnums," Oct. 2003, p. 42.
Gun World, "Hot New Magnums from Smith & Wesson!," Oct. 2003, p. 3.
Women & Guns, Jul.-Aug. 2002, (S&W revolver) pp. 31-32.
Guns Magazine, Jan. 2002, p. 65.
Guns Magazine, "Tool for Parents," Mar. 2003, p. 45.
Handguns, "Eight is Enough," Feb./Mar. 2003, pp. 68-69.
Shooting Times, Aug. 2001, p. 61.
Sportsman's Gun Annual 2003, "Double-Deuce Triple Play," p. 84.
American Rifleman, "Dope Bag," May 1998, p. 47.
Gun Tests, "Taurus Model 85 UL," Dec. 1997, p. 13.
Gun World, Taurus Security System, Feb. 1998, pp. 79-80.
Combat Handguns, Feb. 2001, "New Taurus Tracker .41MAG," by Frank James, cover & pp. 10-12 & 90.
Gun World, "Taurus," Feb. 2003, p. 10.
Gun World, "Taurus," Jun. 2002 p. 76.
American Hunter, "Taurus Model 62," Jan. 2002, p. 65.
Handguns, Feb. 2001, p. 55.
Gun World, "Encore," Oct. 2002, p. 29.
Handguns 2003, ". . . .22LR," p. 37 (Walther P-22).
Guns Magazine, "Gun Locks & Security Devices," Roy Huntington, Feb. 2001, pp. 58-59.
AFTE Journal, Apr. 1980, vol. 12, No. 2, "A Semi-Automatic Carbine With A Unusual Safety Device", Donald L. Gunnell, pp. 30-31.
Shooting Times Quarterly, Summer/1989, "What's New?," by J.B. Wood, cover & pp. 56-58.
American Rifleman, Mar. 1993, "Star Megastar 45 Pistol," p. 67.
American Rifleman, Sep. 1981, "Astra A-80 Pistol," pp. 60-61.
Guns, Jun. 1991, .380 Backups from Beretta, by James E. Fender, pp. 68-70.
Shooting Times, Dec. 2000, p. 70 (Taurus PT 145).
Petersen's Handguns Sep. 1990, "Guns for the Future:," by Dave Arnold, article title pages (2) and pp. 48-55.
Advertisement: Smith & Wesson "Where safety is always on duty," 1 page (source and publication date unknown).
Beeman/Agner (model M80), p. 16 (source and publication date unknown).
Advertisement: Beretta B-Lok 9000S (source and publication date unknown), 2 pages.

H&R Revolver (date and publication unknown).
Article: "Integral Locking System," Wiley Clapp (source and publication date unknown).
American Handgunner, Shutzen Der Walthers (discussing Walther P22) (publication date unknown).
Advertisement: USP Compact Pistols (source and publication date unknown).
Combat Handguns p. 49 (publication date unknown).
Rifle 198, p. 26 (publication date unknown).
Shooting Times, Shooting: Worth a Look, "Remington's New Integrated Security System" (publication date unknown).
Advertisement: "Experience a new Era in Rifle Security: The Sako key Concept," (source and publication date unknown).
Advertisement (Sako): "What's So Great About Blocking the Firing Pin?, " (source and publication date unknown).
Unknown publication, "From Savage for 1970-Rifle Features Key Lock," Friday, Mar. 13, 1970, p. 6.
Combat Handguns, "Two New S&W .357s," p. 27-28 (publication date unknown).
Article: "Raging Bull," G. Sitton, (source and publication date unknown).
Advertisement (Taurus): ".45 ACP to the Tenth Power . . . Plus One," (source and publication date unknown).
Unknown publication, 55th Ed., 2001, p. 121.
"A Tale of Two Trackers," Denis Prisbrey, pp. 11-15 (source and publication date unknown).
Advertisement for Para, "Safest, Smallest, Smoothest .45!," (source and publication date unknown).
"New Steyr M 9mm/.40," (source and publication date unknown), 2 pages.
American Rifleman, "Star Model 28 9 mm Pistol," p. 62 (publication date unknown).

* cited by examiner

FIG. 19
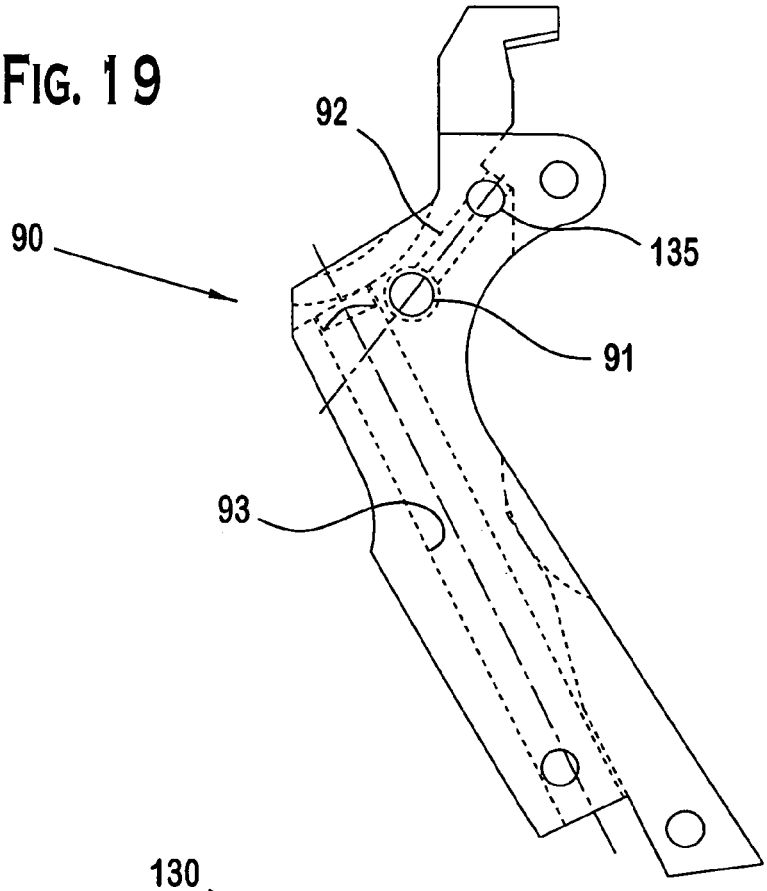
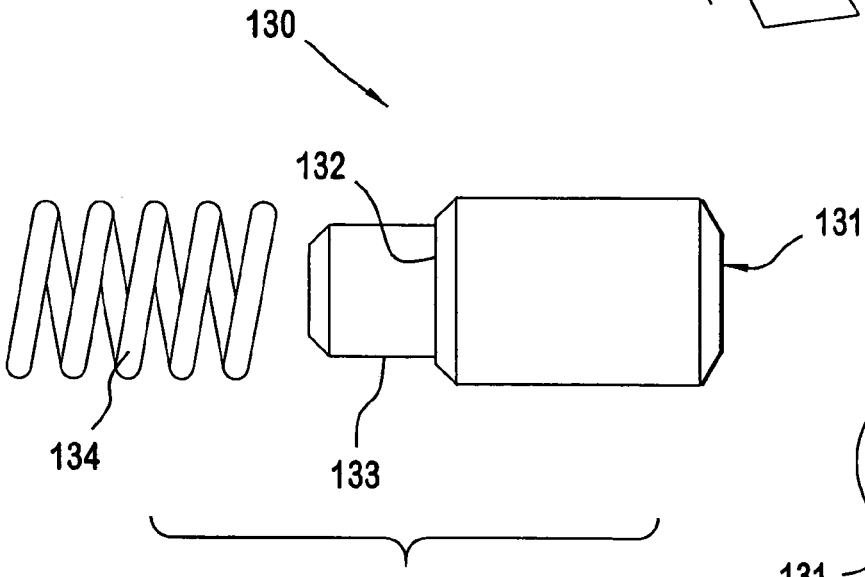
FIG. 20
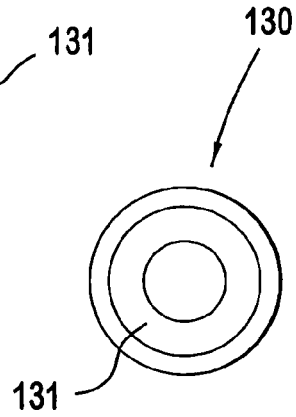
FIG. 21

PISTOL WITH LOCKABLE MANUAL SAFETY MECHANISM

BACKGROUND OF THE INVENTION

The present invention generally relates to firearms, and more particularly to a mechanism related to locking the manual safety mechanism of a pistol.

Prior devices, often referred to as a "manual safety" in the industry, are known that block the discharge of a pistol by disabling the firing apparatus. The firing apparatus typically includes a trigger, trigger bar, sear, and hammer which contacts a firing pin that strikes a chambered cartridge. The sear generally operates to hold the hammer in a cocked "ready-to-fire" position. These components are functionally linked so that pulling the trigger activates the sear which releases a hammer or striker to strike a chambered cartridge and discharge the pistol. When activated, manual safety devices may arrest the movement of one or more of the firing apparatus components to disable the firing assembly and the pistol's ability to be discharged by a trigger pull. Such devices are generally operated by the user physically selecting the position of the manual safety by placing it "on" or "off" in the safety position as desired.

These prior devices, however, do not generally provide a pistol user with the option to manually lock these devices in an activated or "safe" position in which the firing apparatus is disabled. Although optimal methods to secure a pistol to prevent inadvertent discharge or unauthorized access are to fully unload the pistol and store it in a lockable box, in a safe, or to affix an external lock such as those supplied by most pistol manufacturers, an added measure of precaution can be achieved via a manually-operated supplemental mechanism, that when activated, can physically engage such prior devices to lock them in their "safe" position.

SUMMARY OF THE INVENTION

A lockable and selectively movable lockable manual safety mechanism for a pistol is provided that in one operative "safe" position disables the firing apparatus of the pistol so that the pistol cannot be discharged. In a preferred embodiment, the lockable manual safety mechanism engages the sear so that it cannot be moved in response to a trigger pull to release a cocked hammer. Accordingly, with the lockable manual safety mechanism engaged and motion of the hammer arrested, the cocked hammer cannot move forward to strike the firing pin and discharge the pistol. To enable the firing apparatus, the user must first move the lockable manual safety mechanism to a second "ready-to-fire" position in which the manual safety mechanism is disengaged from the sear. This allows the sear to move in response to a trigger pull, which releases the cocked hammer to discharge the pistol. In a preferred embodiment, the lockable manual safety mechanism may further includes a locking member to manually lock the manual safety mechanism in the foregoing "safe" position wherein the firing apparatus is disabled. When the locking mechanism is activated, the position of the manual safety mechanism cannot be changed without first manually deactivating the locking mechanism. Preferably, the locking mechanism is activated by a removable key so that the locking mechanism cannot be deactivated without the key.

A preferred embodiment of a pistol having a lockable manual safety mechanism includes a frame, a hammer pivotally mounted to the frame, and a sear engageable with the hammer. The sear is operable to hold the hammer in a cocked position, and further to release the hammer from the cocked position to discharge the pistol by striking a firing pin which may be provided that contacts a cartridge loaded in the pistol. A manual safety is provided that is movable into and out of engagement with the sear. The safety, when engaged with the sear, prevents the sear from moving and releasing the hammer or striker while held in the cocked position by the sear to prevent discharge of the pistol. A locking member is provided that is movable from an unlocked position in which the safety is freely movable to a locked position in which the locking member engages the safety so that the safety cannot freely move and is locked into engagement with the sear while the hammer or striker is held in the cocked position by the sear. Preferably, the locking member is movable in a lateral direction between the locked and unlocked positions. In one embodiment, the safety further includes a locking surface and the locking member further includes a complimentary configured engaging surface. The locking surface meshes with the engaging surface when the locking member is in the locked position. In one embodiment, the engaging surface is concave and the meshing locking surface is convex.

In another embodiment, the pistol includes a housing to carry the locking member. The locking member may be movable in the housing and may be recessed within the housing when in the unlocked position. When in the locked position, the locking member may protrude outward from the housing to engage the safety. Preferably, the locking member is rotatably carried by the housing and movable in a lateral direction between the locked and unlocked positions. In one embodiment, the locking member has external threads and the housing has an internally-threaded passageway to rotatably receive the locking member. Preferably, the threaded passageway is oriented transversely in the pistol. The locking member is movable in a lateral direction between the locked and unlocked positions by rotating the locking member which engages the threads of the locking member with the threads of the passageway. In one embodiment, the locking member may be moved in two directions by rotating the locking member in opposite directions.

In another embodiment, a spring-loaded detent plunger may be provided. The locking member may further include a shaft configured to engage the plunger. Preferably, the plunger may be biased toward and engages the shaft so that the locking member resists rotation unless manually rotated by a pistol user. This prevents the locking member from rotating within the housing passageway on its own due to vibration which may be caused by simply moving the pistol, discharging the pistol, etc. In one embodiment, the shaft includes at least one flat surface to engage a complimentary flat surface on the detent plunger. The plunger may be cylindrical in shape, or have any other suitable configuration as a matter of design choice. In another embodiment, the locking member is operated with a key by a user to move the locking member between the locked and unlocked positions. The key is preferably configured to engage a complimentary and engageable configuration on the locking member.

According to another embodiment of a pistol having a lockable manual safety mechanism that may be locked, the pistol includes a frame, a hammer that is pivotally mounted to the frame, and a sear that is engageable with the hammer and includes a protrusion. In one embodiment, the sear includes a catch which is configured to engage a complimentary notch in the hammer. The sear is operable to hold the hammer in a cocked position, which in one embodiment is accomplished by the sear catch and hammer notch. The sear is further to release the hammer from the cocked position to discharge the pistol.

In the preferred embodiment, a safety is further provided in the form of a lever that is movable into and out of engagement with the sear. The lever may have a hook to engage the sear protrusion and a locking surface. When the lever is engaged with the sear, the lever prevents the sear from moving and releasing the hammer while held in the cocked position by the sear. A rotatable lock pin having an engaging surface may be provided. Preferably, the lock pin may be rotated by a user of the pistol with a key which may also be provided. The lock pin may be movable in a lateral direction by a pistol user to mesh the engaging surface with the locking surface of the lever. In one embodiment, the lock pin locks the safety into engagement with the sear while the hammer is held in the cocked position by the sear to prevent the sear from releasing the hammer. In one embodiment, the locking surface of the lever is concave and the engaging surface of the lock pin is convex.

In another embodiment, the lock pin may be laterally oriented and threadably disposed in the frame such that rotating the lock pin in opposite directions laterally moves the lock pin with respect to the frame both into and out of engagement with the lever. In one embodiment, a separate housing may be disposed in the frame to carry the lock pin. A key may be provided in another embodiment that has an end configured to engage a complimentary-configured recess in the lock pin. The key is useable by the pistol user to rotate the lock pin and lock the lever into engagement with the sear.

In another embodiment, the lock pin further includes a shaft having a diameter and two ends. A first radially-protruding cylindrical flange may be disposed on one end of the shaft. The flange may have a diameter larger than the diameter of the shaft. In one embodiment, the engaging surface of the lock pin may be disposed on the flange. In another embodiment, a housing having an internally threaded passageway may be provided to carry the lock pin. The lock pin flange preferably has external threads to engage the threaded passageway. In one embodiment, the lock pin is movable from a first lateral position in which the lock pin is recessed within the housing to a second lateral position in which at least a part of the lock pin protrudes outward from the housing to engage the safety. In another embodiment, a detent plunger biased into contact with the lock pin shaft is provided. The lock pin may further include a second radially-protruding cylindrical flange disposed on the other end of the shaft and spaced apart from the first flange. This arrangement results in the plunger being trapped between the two flanges to prevent the lock pin from being laterally unthreaded and removed from the housing by a user without disassembling the pistol. In one embodiment, a key configured to engage the lock pin may be provided that may be used by a pistol user to activate and move the lock pin between the first and second positions.

A method of locking a manual safety mechanism for a pistol is also provided. The method includes: cocking a hammer that is pivotally mounted in a pistol frame to strike a firing pin; engaging the cocked hammer with a rotatable sear to hold the hammer in position, the sear being rotatable to release the hammer to strike the firing pin; engaging the sear with a movable manual safety to prevent the sear from moving to release the cocked hammer; and locking the manual safety into engagement with the sear to prevent discharging the pistol. In one embodiment, the step of locking the manual safety into engagement with the sear may be preceded by a step that comprises rotating a lock pin into engagement with the manual safety. In another embodiment, step of locking the manual safety into engagement with the sear may be preceded by the steps of rotating a lock pin disposed in the frame, and moving the lock pin laterally into engagement with the manual safety.

As the terms are used herein, the "front" of a pistol is defined as the barrel end and the "rear" of a pistol is defined as the handle or grip end. With the barrel positioned parallel to the ground, the term "top" in reference to the pistol is defined as the upper portion generally containing the aiming sight. The term "bottom" in reference to the pistol is defined as the lower portion generally containing the trigger. The "left side" of a pistol is defined as the side visible when the barrel points towards the left and the "right side" is the side visible when the barrel points to the right. Also as the terms may be used herein with respect to orientation using the pistol as a frame of reference to direction, "forward" indicates a direction towards the muzzle (front of barrel) end of the pistol and "rearward" indicates a direction towards the handle or grip end of the pistol. "Downwards" indicates a direction towards the bottom or underside of the pistol and "upwards" indicates a direction towards the top of the pistol opposite the bottom or underside. "Behind" indicates a location or position to the rear.

As used herein, any reference to either orientation or direction is intended primarily for the convenience in describing the preferred embodiment and is not intended in any way to limit the scope of the present invention thereto.

Although the preferred embodiment of a magazine disconnect mechanism will be described for convenience with reference to a pistol having a receiver that is fixed on the grip frame, and a bolt that is slidably movable within the receiver in response to recoil forces developed during firing, the invention is not limited in its applicability by such reference. Accordingly, the preferred embodiment may also be used in pistols having a movable bolt in the form of a slide that is slidably mounted on the grip frame to move in response to the recoil forces developed during firing.

BRIEF DESCRIPTION OF THE DRAWINGS

The features of the preferred embodiments will be described with reference to the following drawings where like elements are labeled similarly, and in which:

FIG. 19 is a left side elevation view of the mainspring housing of the pistol of FIG. 1;

FIG. 20 is a side elevation view of the detent plunger and spring of the lockable manual safety mechanism of the pistol of FIG. 1; and FIG. 21 is an end view of the detent plunger of FIG. 20.

DESCRIPTION OF THE PREFERRED EMBODIMENTS

Figure 1:
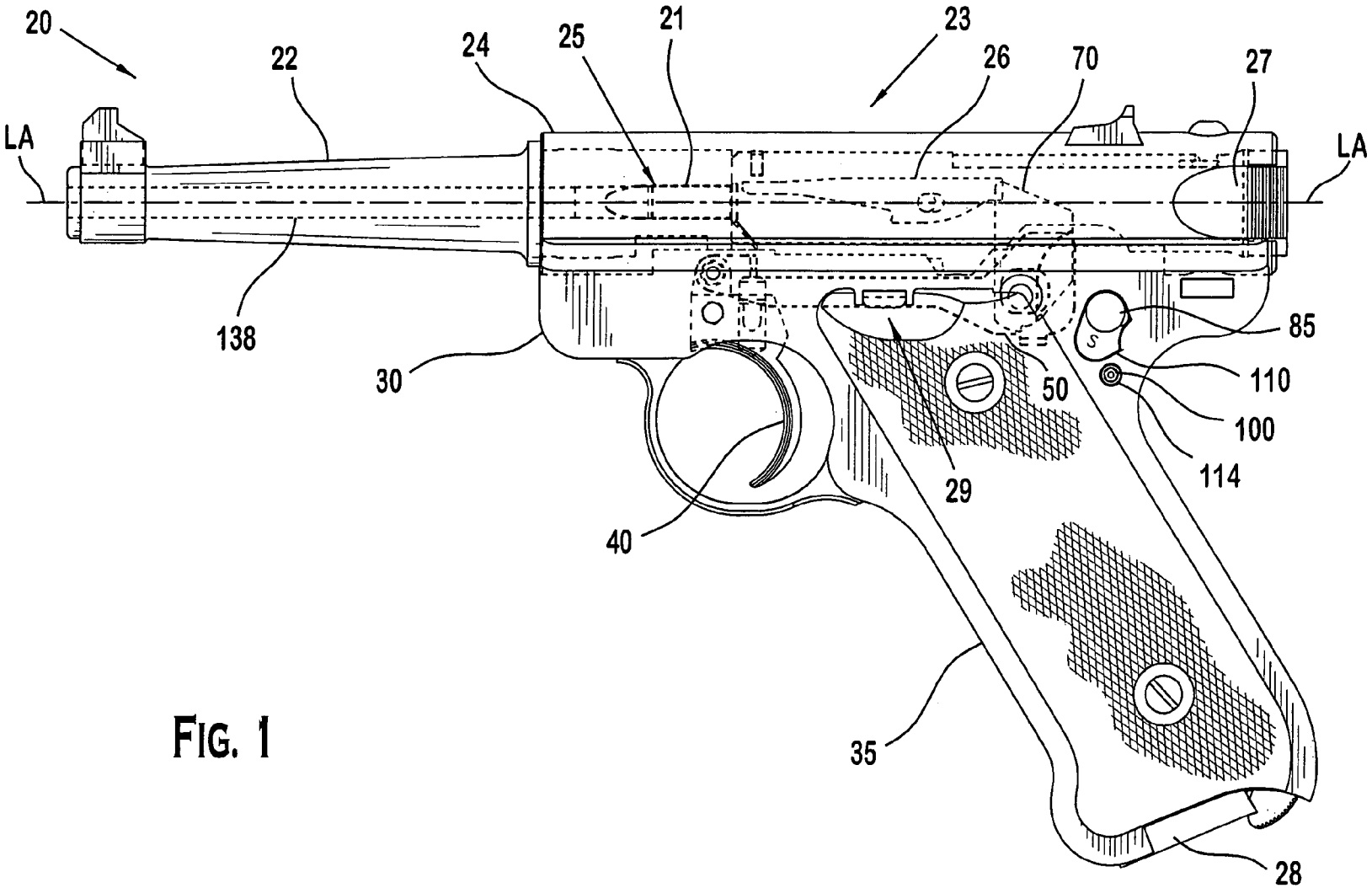
FIG. 1 is a left side view of a preferred embodiment of a firearm in the form of a pistol having a lockable manual safety mechanism.

Referring generally to FIG. 1, a preferred embodiment will now be described for convenience with reference and without limitation to a rimfire-type pistol in the form of an auto-loading pistol.

Pistol 20 generally includes: a grip frame 30 having a grip frame handle portion 35 defining a downwardly open cavity 122 (see FIG. 13) that receives and holds a removable magazine 28 for containing cartridges 25; a longitudinally-extending barrel 22 carried by frame 30 and containing a bore 138; a generally hollow-structured receiver 24 carried by frame 30; a slideable bolt 27 disposed in the receiver; a firing apparatus 29 to discharge pistol 20; and a lockable manual safety mechanism operably associated with and capable of disabling the firing apparatus. Receiver 24 is preferably coupled to barrel 22; the combination defining a barrel-receiver assembly 23. Barrel-receiver assembly 23 defines a chamber 21 therein that communicates with barrel bore 138, and is configured and sized to receive cartridge-type ammunition such as cartridge 25. In a preferred embodiment, chamber 21 may be a cylindrical longitudinal bore concentrically-aligned with barrel bore 138.

Barrel bore 138 and chamber 21 collectively define a longitudinal axis "LA" for pistol 20 passing therethrough along an axial centerline through bore 138 and chamber 21. A transverse axis "TA" is defined perpendicular to the longitudinal axis LA. The term "transverse" as used herein indicates a direction parallel to the transverse axis TA. The term "lateral" as used herein indicates an orientation and/or direction parallel to the transverse axis TA and towards either side of pistol 20.

Pistol 20 further includes bolt 27 slidably disposed in barrel-receiver assembly 23 and axially movable in response to recoil forces developed during discharging pistol 20. Bolt 27 preferably moves a reciprocating manner in a longitudinal direction. After pistol 20 is discharged, bolt 27 automatically moves rearwards due to the recoil force from firing which allows a spent cartridge casing to be ejected and a new cartridge 25 to be uploaded from magazine 28 and positioned in receiver 24. A recoil spring (not shown) then automatically returns bolt 27 forward by and pushes and loads the a new cartridge 25 into chamber 21. Bolt 27 is also manually retractable which cocks hammer 70 and initially readies pistol 20 for semi-automatic operation. A pistol user may also manually retract bolt 27 to manually load a single cartridge 50 into chamber 21 to use pistol 20 as a single-shot pistol.

A firing pin 26 is slidably disposed in barrel-receiver assembly 23 and movable in a reciprocating forward and rearward longitudinal direction to strike the rear of cartridge 25 which may be loaded in chamber 21. Through firing apparatus 29, firing pin 36 is mechanically actuated by pulling trigger 40. When firing pin 26 strikes cartridge 25, impact-sensitive primer powder ignites which flashes and in turn ignites a powder charge to fire the cartridge.

Figure 2:
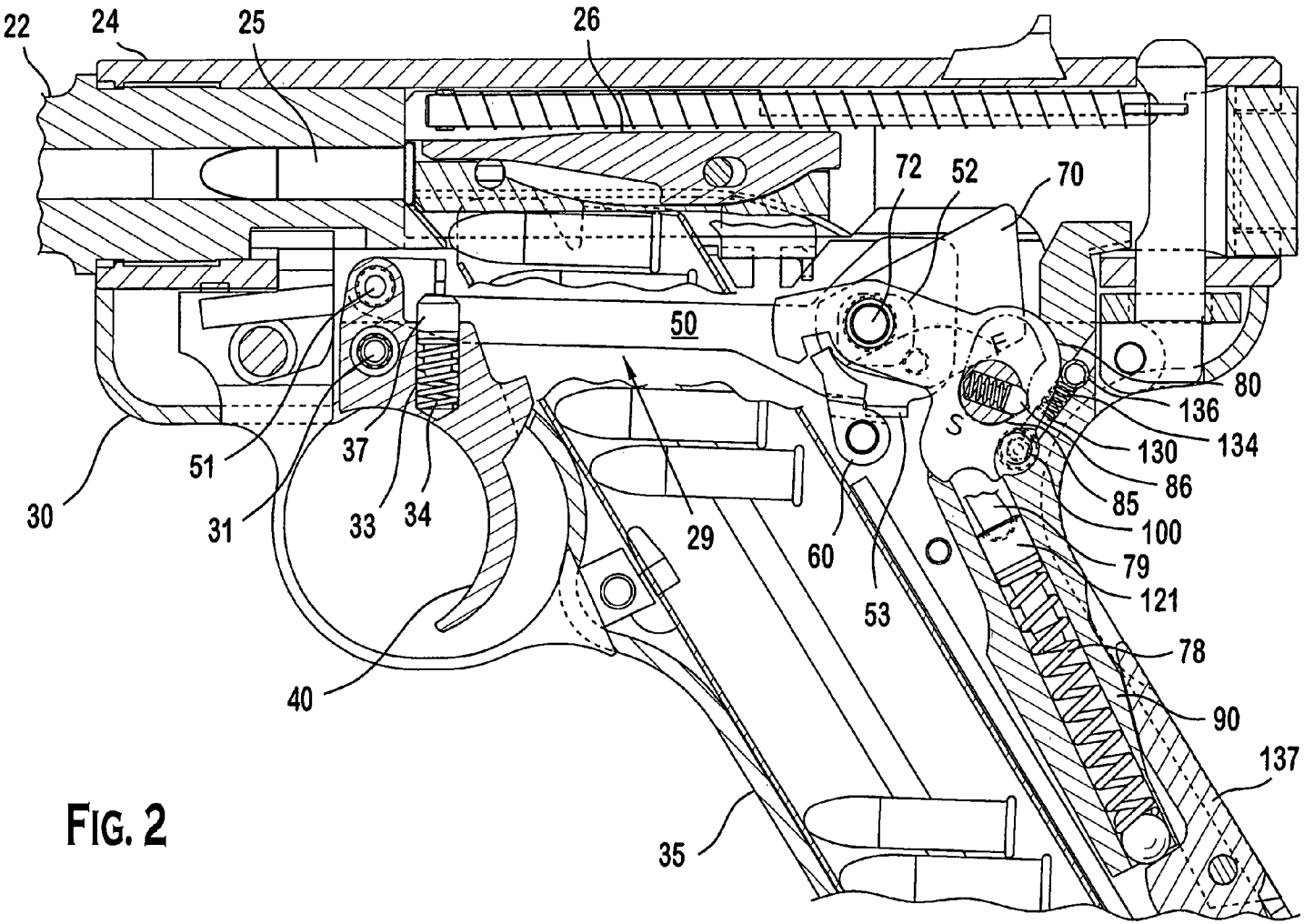
FIG. 2 is a partial left side enlarged view of the pistol of FIG. 1 showing the firing apparatus in a "ready-to-fire" position.
Figure 4:
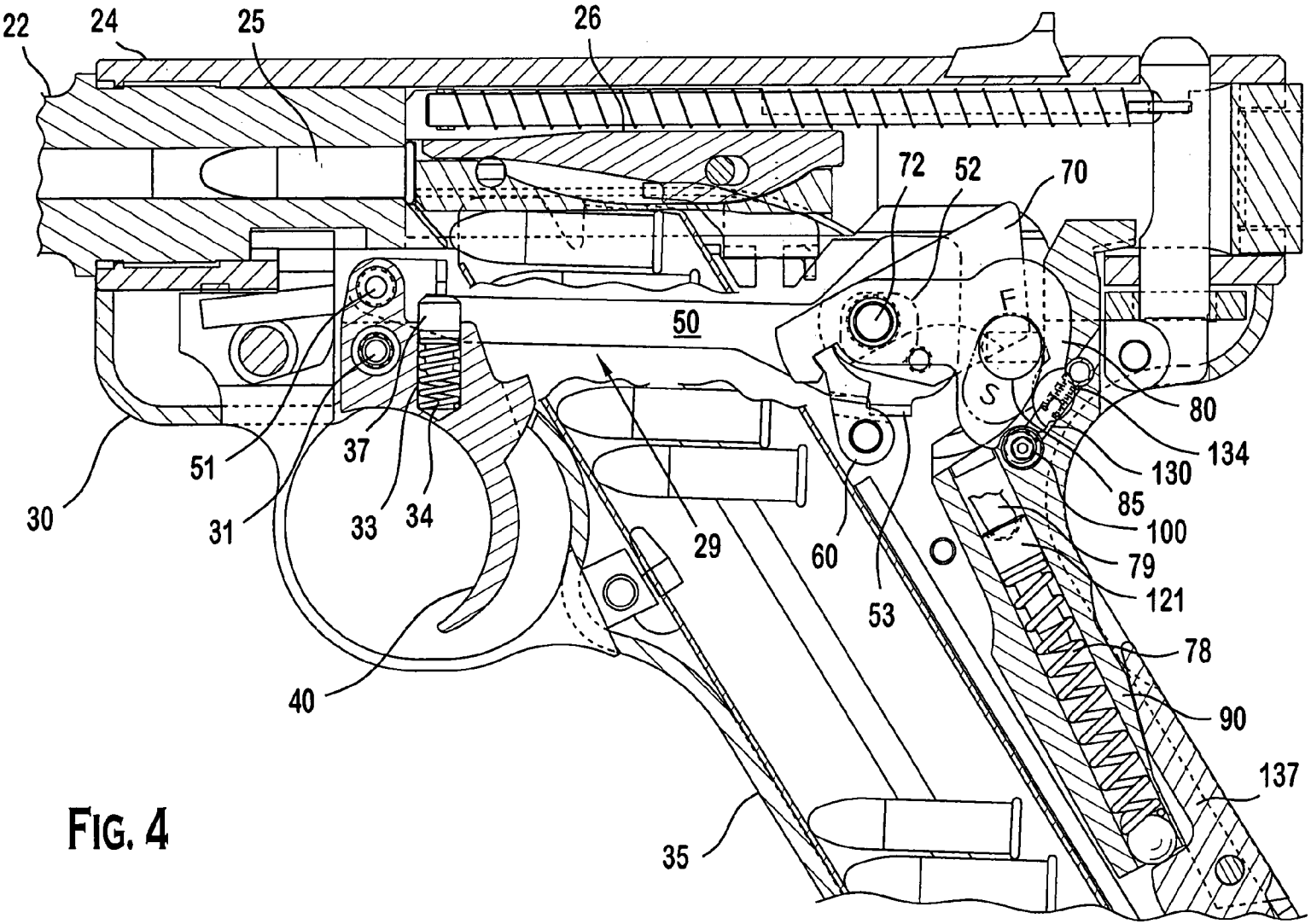
FIG. 4 is a partial left side enlarged view of the pistol of FIG. 1 showing the firing apparatus in a "safe" position.

With additional reference to FIGS. 2 and 4, firing apparatus 29 allows a user of pistol 20 to discharge a chambered cartridge. Firing apparatus 29 generally includes a trigger 40, trigger bar 50, sear 60, and hammer 70, all positioned and arranged in mutual operable relationship. Trigger 40 controls the position and movement of hammer 70 via linkages and interaction of the firing apparatus 29 components. In general operation, a pistol user pulls trigger 40 rearward which releases a pre-cocked and spring-biased hammer 70, allowing it to move forward and strike the rear of firing pin 26. This propels firing pin 26 forward to strike the rear of cartridge 25 and discharge pistol 20 in the manner previously described.

Figure 7:
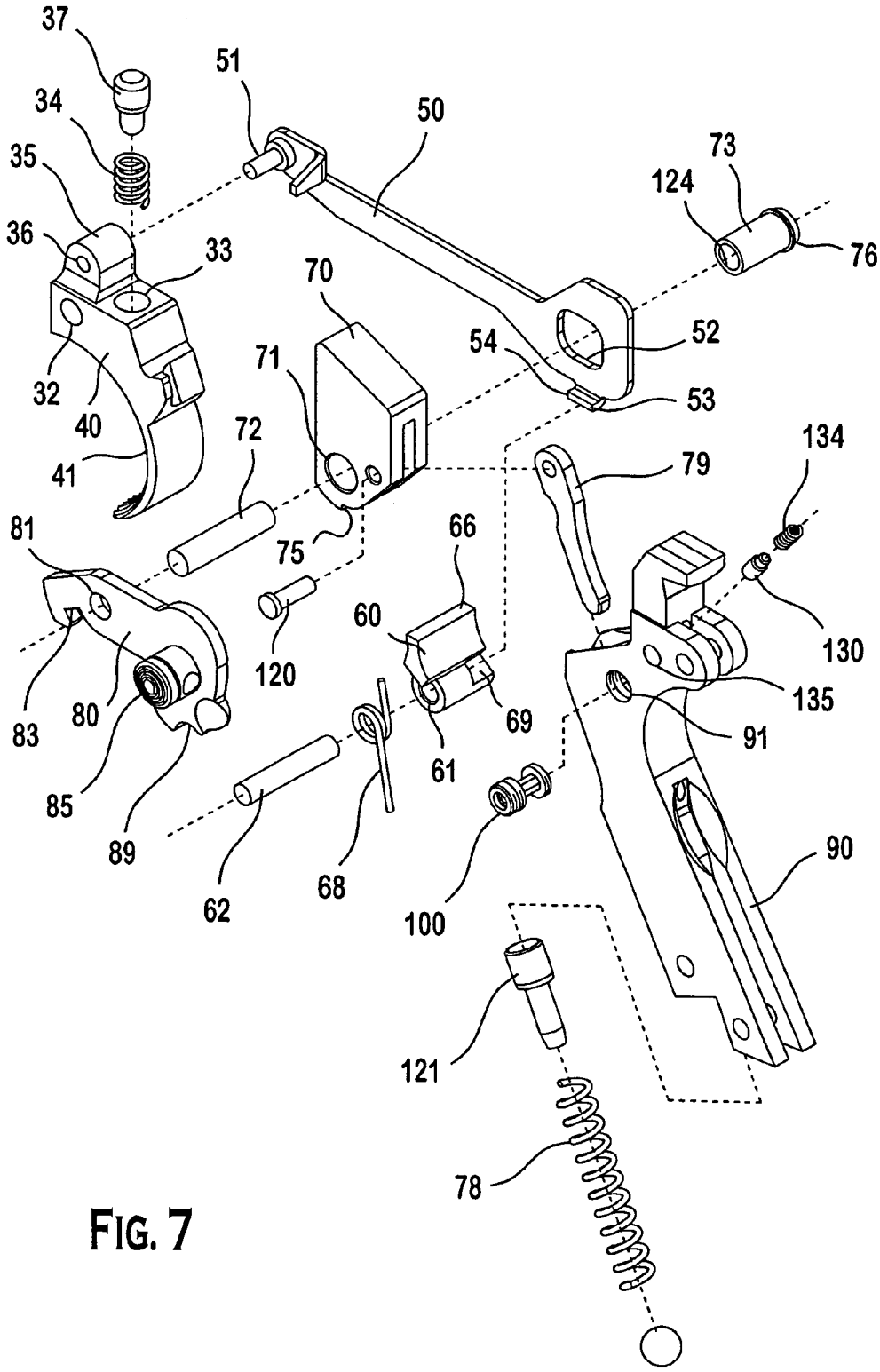
FIG. 7 is an exploded view of the firing apparatus and other components of the pistol of FIG. 1.

As shown in FIG. 7, trigger 40 has a curved finger portion 41 and is pivotally connected to grip frame 30 about transverse-mounted pivot pin 31 received through hole 32 of the trigger (see FIG. 2). Trigger 40 is biased in a clockwise and forward direction (when viewed from FIG. 2) by a spring 34 acting in a downwards direction through spring cavity 33 shown in FIG. 7. An upwardly-extending protrusion 35 is provided which contains hole 36 to mechanically link trigger bar 50 to trigger 40. Trigger bar 50 has a corresponding cylindrical lateral protrusion 51 which is received in trigger hole 36. Pulling trigger 40 rearwards causes trigger 40 to pivot counterclockwise about pivot pin 31, thereby causing trigger bar 50 to move generally longitudinally forwards. Trigger bar 50 may be an elongated and plate-like structure as shown. At the rear of trigger bar 50 is window 52 passing completely through the trigger bar. Window 52 is sized sufficiently large enough to allow hammer pivot pin 72 and bushing 73 to pass through without binding through the full range of longitudinal motion of trigger bar 50 when moved by a trigger pull. At the bottom rear of trigger bar 50 is laterally-extending protrusion 53 which is configured to operably engage sear 60.

Figure 10:
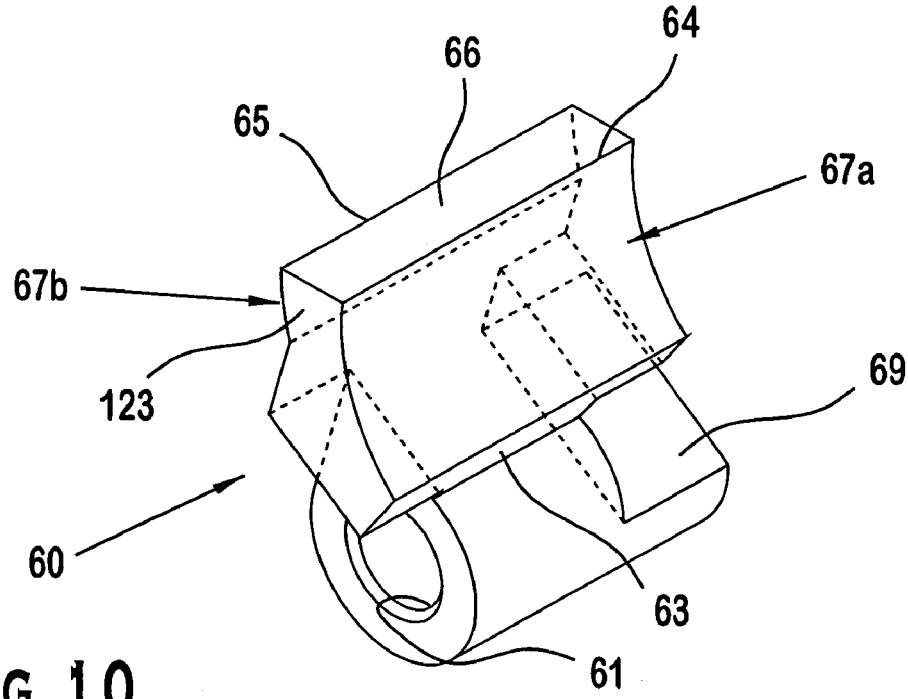
FIG. 10 is a rear perspective view of the sear of the pistol of FIG. 1.

With continuing reference to FIG. 7, and additional reference to FIG. 10, sear 60 is pivotally and transversely mounted to grip frame 30 about pivot pin 62 which is received in sear hole 61 and provides pivotal movement for the sear. Sear spring 68 fitted on pivot pin 62 preferably biases sear 60 upwards in a clockwise direction (as viewed in FIG. 2) toward engagement with hammer 70. Sear 60 includes spaced-apart laterally-extending rear and front upper edges 64, 65, respectively, connected by upper surface 66 therebetween. Adjacent to front edge 65 is upper front wall **67*b* and adjacent rear edge 64 is upper rear wall 67*a*. Edges 64, 65, upper surface 66, and walls 67*a*, 67*b* collectively define a protrusion 123 for engagement with hammer 70 and lever 80. In one embodiment, rear wall 67*a* may be curved to avoid interference with the bottom and pivotal movement of hammer 70. A rear lower vertical contact wall 63 may be provided on sear 60 to operably engage lateral protrusion 53, and preferably vertical contact surface 54, of trigger bar 50. Accordingly, pivotal movement of sear 60 is linked to and controlled by trigger bar 50. Preferably, a substantially squared-off trigger bar notch 69 is formed in the rear of sear 60 at vertical contact wall 63 as shown to positively engage trigger bar protrusion 53, which preferably is substantially rectangular in cross-section and may include a substantially flat, vertical front contact surface 54 (see FIG. 7). Trigger bar contact surface 54 preferably engages sear vertical contact wall 63** which in one embodiment is also substantially flat.

Figure 8:
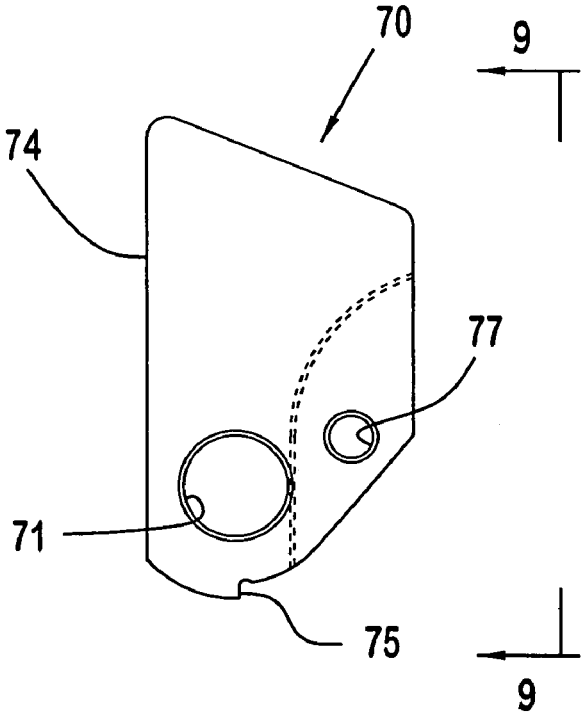
FIG. 8 is a left side view of the hammer of the pistol of FIG. 1.
Figure 9:
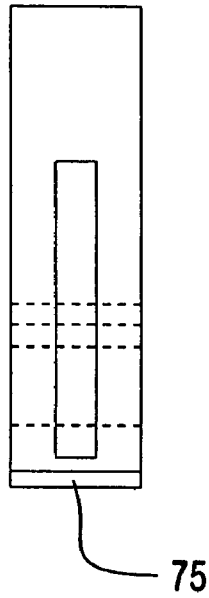
FIG. 9 is a rear elevation view of hammer of the pistol of FIG. 1.

Referring to FIGS. 7-9, hammer 70 is pivotally mounted to grip frame 30 via pivot pin 72 which is received through hole 71 in hammer 70. Pivot pin 72 at one end is preferably received in cylindrical cavity 124 of hammer bushing 73 which may also include a radially-protruding round flange 76 (see FIG. 7) to help retain bushing 73 in position in grip frame 30. Hammer 70 further includes laterally-extending notch 75 to engage sear 60. Hammer 70 is biased forward (counterclockwise as viewed in FIG. 2) by a helical mainspring 78 disposed in elongated cavity 93 of mainspring housing 90 (see FIG. 19). Mainspring 78 acts upwards through (see FIG. 8) hammer 70 via an operable connection provided by hammer strut pin 120 received transversely in strut pivot pin hole 77, movable hammer strut 79, and mainspring plunger 121 disposed in cavity 93 between strut 79 and mainspring 78 (these components best shown in FIG. 7). Front surface 74 on hammer 70 (see FIG. 8) is configured to make operable contact with firing pin 26 which is capable of moving forward and striking a cartridge 25 loaded in chamber 21 of pistol 20.

Sear 60 controls the operation and movement of hammer 70, and in turn discharge of pistol 20. Sear 60 is operable to hold hammer 70 in a cocked ready-to-fire position, and to subsequently release hammer 70 (which is spring-biased forwards) in response to pulling trigger 40 so that hammer 70 may strike firing pin 26 to discharge pistol 20. As best shown in FIG. 2, hammer notch 75 is engaged with sear 60 when hammer 70 is held in the cocked ready-to-fire position by the sear. Preferably, in one embodiment, notch 75 is configured and arranged to engage a catch included on sear 60 which may be sear protrusion 123 or part of protrusion 123. In the preferred embodiment, hammer notch 75 is engaged by rear edge 64 of sear protrusion 123 (see FIG. 10). Engagement between rear edge 64 of sear 60 and hammer notch 75 holds hammer 70 in the rearward cocked position (see FIG. 2). Pulling trigger 40 to discharge pistol 20 moves trigger bar 50 forward, thereby engaging lateral protrusion 53 (and preferably vertical surface 54 thereon) with sear 60. Trigger bar 50 causes sear 60 to rotate forward (counter-clockwise as viewed in FIG. 2) about its pivot pin 62 which in turn disengages hammer notch 75 from sear 60. Hammer 70 is thus released and rotates forward (counter-clockwise as viewed in FIG. 2) to strike firing pin 26 and discharge pistol 20.

In the preferred embodiment, the lockable manual safety mechanism arrests movement of foregoing firing apparatus 29 by selectively engaging and locking sear 60 in position when engaged with hammer 70 in a cocked rearward position. This prevents cocked hammer 70 from being released and striking firing pin 26. Sear 60 also acts as a trigger stop because the sear cannot be moved by trigger bar 50 in response to a trigger pull. It should be noted that there may be some slight slack or play in trigger 40; however, a full trigger pull cannot be made.

Figure 11:
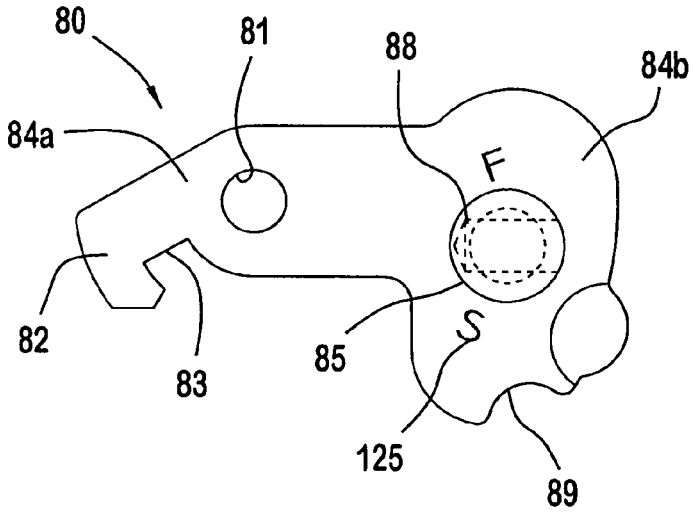
FIG. 11 is a left side elevation view of the safety of the pistol of FIG. 1.
Figure 12:
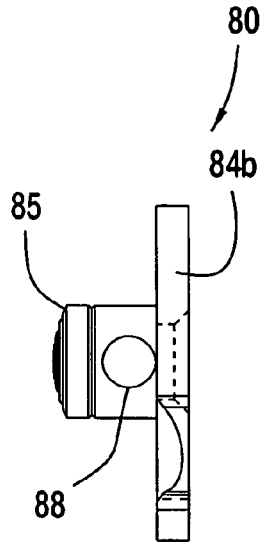
FIG. 12 is a rear elevation view of the safety of the pistol of FIG. 1.

The lockable manual safety mechanism includes a manual safety such as lever 80 which in the preferred embodiment is a substantially flat plate or blade-like component as shown in FIGS. 7 and 11-12. Preferably, lever 80 engages and arrests movement of sear 60 to disable the firing apparatus 29. Lever 80 may be pivotally mounted on hammer pivot pin 72 passing through pivot hole 81 with lever 80 arranged between hammer 70 and grip frame 30 on the left side of pistol 20 (see FIG. 7 for assembly relationship). Preferably, hole 81 is located in or proximate to front portion **84*a* of lever 80. In one embodiment, forward of pivot hole 81 in front portion 84*a* may be hook 82 configured and adapted to engage sear 60. Preferably, hook 82 includes a recess 83 shaped to engage a complimentary-shaped portion of sear 60, as shown in FIG. 4. In one embodiment, recess 83 is generally shaped to match the generally square profile of sear protrusion 123 defined by front and rear upper sear surfaces 67*a*, 67*b* and upper surface 66 extending between surfaces 67*a* and 67*b*. Preferably, recess 83 is located forward of pivot pin hole 81 so that front portion 84*a* moves in an opposite rotational direction to rear portion 84*b*. It should be noted, however, that other suitable arrangement of hook 82 in relation to pivot hole 81 are contemplated so long as hook 82 may be moved into and out of engagement with sear 60 by manually moving lever 80**.

Rear portion **84*b* of lever 80 may be broadened in contrast to the rest of lever 80 to allow indicia 125 denoting "safe" (e.g., "S") and "ready-to-fire" (e.g., "F") positions to be added to the surface of lever 80. Rear portion 84*b* also preferably includes a laterally-extending knob 85 mounted on a side of lever 80 so that knob 85 may protrude through window 110, which in-one embodiment is disposed in the left side of grip frame 30 (see FIGS. 1 and 13). Knob 85 is used by a pistol user to manually move lever 80 between different operating positions, preferably into and out of engagement with sear 60. With lever pivot hole 81 located between hook 82 and knob 85, hook 82 may move in an opposite vertical direction than knob 85 such that moving knob 85 downwards concomitantly moves hook 82** upwards, and vice-versa.

Figure 5:
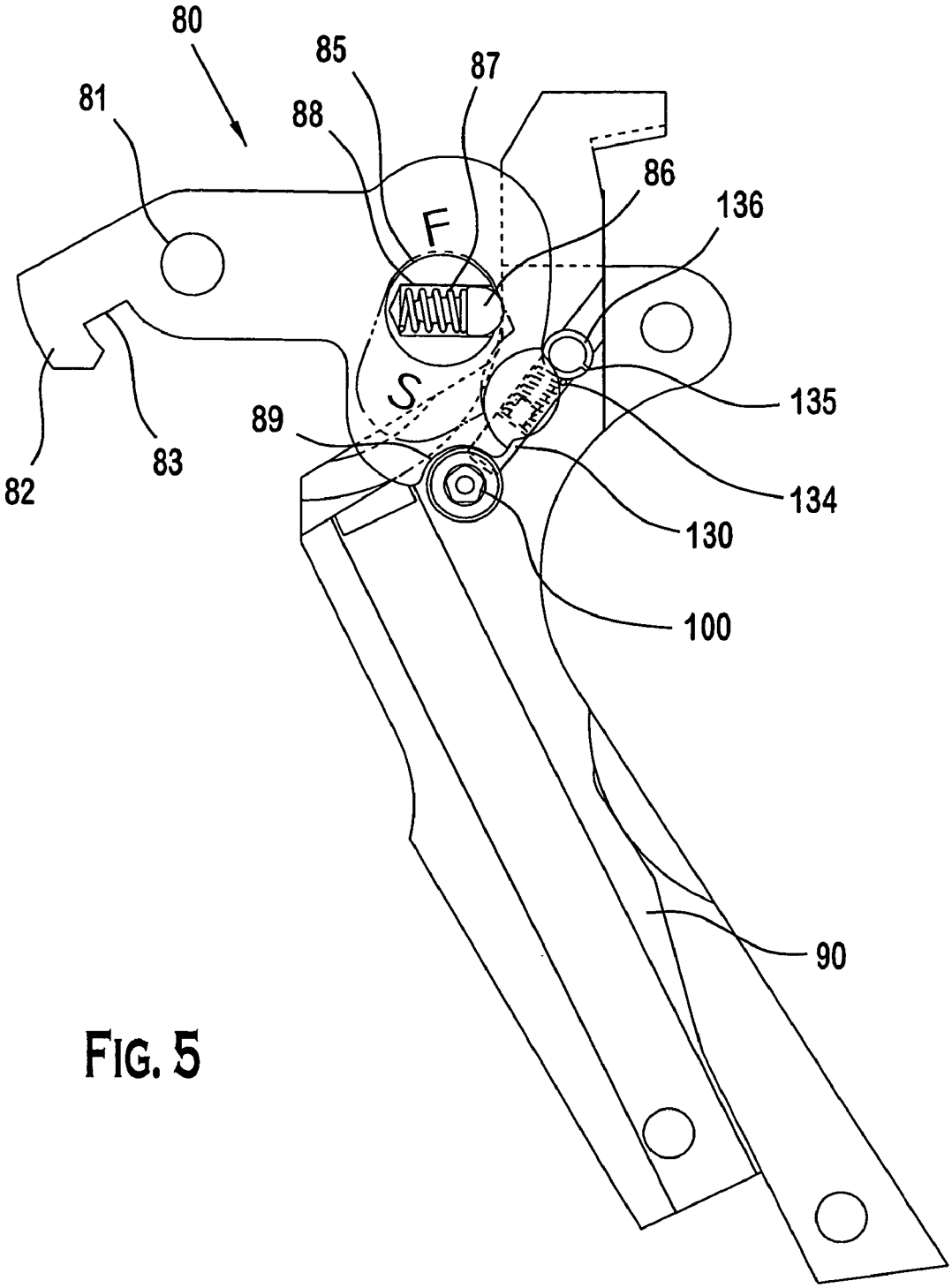
FIG. 5 is a left side elevation view of the mainspring housing and lockable manual safety mechanism of the pistol of FIG. 1.
Figure 13:
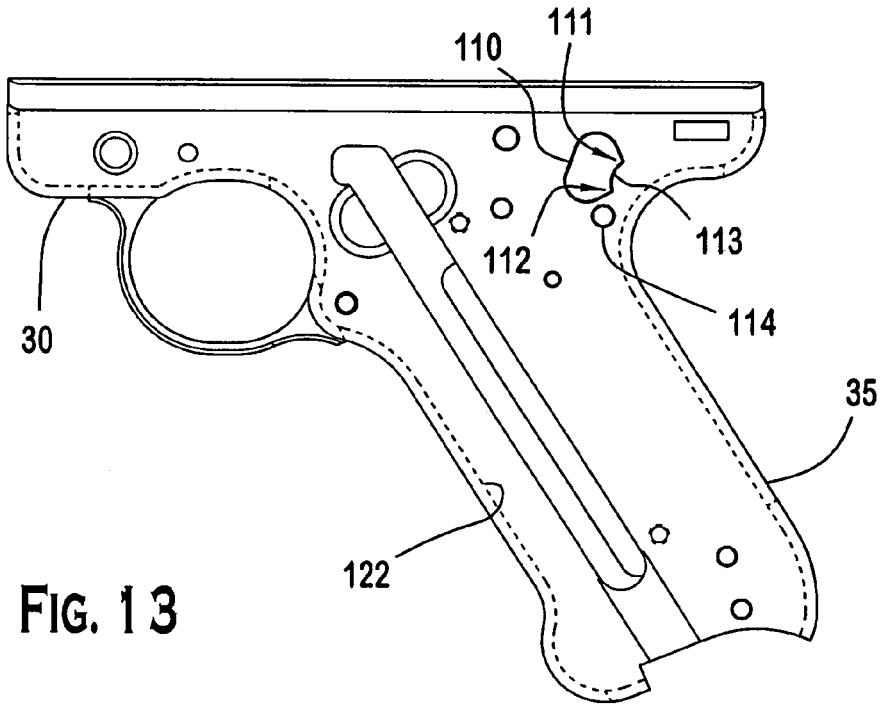
FIG. 13 is a left side elevation view of the frame of the pistol of FIG. 1.

Knob 85 may have a cavity 88 for holding a spring-loaded detent 86 and helical detent spring 87 (see FIG. 5). Window 110 is preferably has an elongated shape, and is configured and arranged to define two seated positions for knob detent 86, which coincide with two possible operating positions for lever 80. In one embodiment, these two seated positions may be created by spaced-apart upper and lower V-shaped notches 111, 112 formed at corners in the rear of window 110 where an inwardly-curved or concave arcuate surface 113 meets window 110, as best shown in FIG. 13. Curved or arcuate surface 113 is sufficiently deep in a transverse or lateral direction extending from the left to right side of pistol 20 such that spring-loaded detent 86 may be securely seated and engaged by surface 113 and notches 111, 112. When knob 85 is seated in either window notch 111 or 112, detent spring 87 is in an expanded position and detent 86 is seated in either notches 111 or 112. As knob 85 is moved between notches 111, 112, inwardly-curved surface 113 compresses detent spring 87 until either notch is reached whereupon spring 87 expands again to seat detent 86 in the respective notch. Preferably, detent 86 has a rounded head as shown in FIG. 5 so that the detent smoothly moves along inwardly-curved surface 113 between notches 111, 112 at opposite ends of window 110, and into and out of the notches when engaged or disengaged therefrom.

Lever 80 is preferably manually moveable from a first upward position in which sear 60 is engaged and immovable (i.e., a "safe" position as shown in FIG. 4) to a second downward position in which sear 60 is movable (i.e., a "ready-to-fire" position as shown in FIG. 2). In the first position, knob 85 is positioned near the top of grip frame window 110 as shown in FIG. 4 In the second position, knob 85 is positioned near the bottom of grip frame window 110 as shown in FIG. 2. Spring-loaded detent 86 helps hold lever 80 in these two positions, as discussed above.

Lever 80 is configured to receive and be operably engaged by a rotatable locking member such as lock pin 100 (see FIG. 14) which may be used by a pistol user to lock lever 80 in the "safe" position. Preferably, lock pin 100 is movable from an "unlocked" position to a "locked" position in which lock pin 100 engages and prevents movement of lever 80. In one embodiment shown in FIG. 11, lever 80 includes a locking surface such as concave surface 89. Locking concave surface 89 is preferably configured to match and mesh with a complimentary-shaped lever engaging surface of safety lock pin 100. In one embodiment, lever concave surface 89 receives and meshes with cylindrical flange 102*a* of lock pin 100 (see FIG. 15), which provides a complimentary convex surface, to prevent pivotal movement of lever 80 when the flange engages concave surface 89. In one embodiment, concave surface 89 may be disposed in the bottom rear portion 84 of lever 80 and opens outwardly and downwardly, as shown. In one embodiment, lock pin 100 is preferably key-operated.

It should be noted that although concave surface 89 is preferably semi-circular in shape and flange 102*a* preferably has a cylindrical configuration with convex or round convex profile in one embodiment, other suitable combinations of complimentary and mating shapes may be used so long as lock pin 100 may engage and arrest the movement of lever 80. It should further be noted that concave surface 89 may be completely circumscribed by lever 80 and configured as a circular hole to receive lock pin 100 with no outwardly open portion like concave surface 89.

Figures 14, 15, 16:
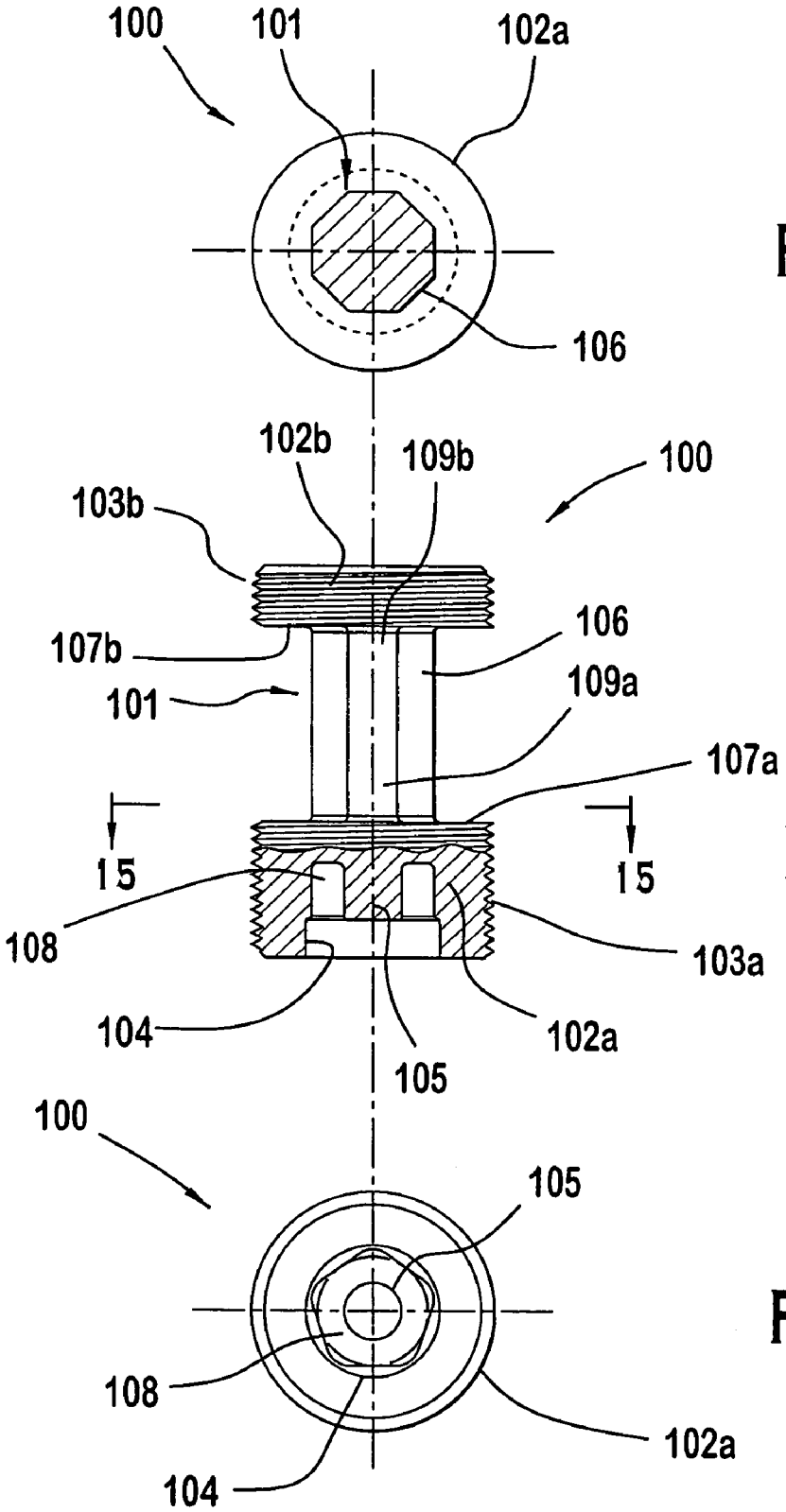
FIG. 14 is a top view of the lock pin of the pistol of FIG. 1 with one end cutaway to reveal the internal structure.
FIG. 15 is a cross section of the lock pin taken along line 15-15 in FIG. 14.
FIG. 16 is a left side end view of the lock pin of the pistol of FIG. 1.

Referring to FIGS. 14-16, lock pin 100 may be generally barbell-shaped in one embodiment having a shaft 101 with two ends 109*a*, 109*b* and cylindrical radially-protruding enlarged flanges 102*a*, 102*b* attached to either end of shaft 101. Accordingly, flanges 102*a*, 102*b* preferably have a larger outside diameter than the outside diameter of shaft 101. One flange, preferably 102*a* which may be disposed facing the left side of pistol 20 when installed, defines a key-receiving recess 104 with cylindrical protrusion 105 disposed therein. Recess 104 and protrusion 105 are preferably configured to match a mating configuration disposed on the shaft of a lock key 300 (see FIGS. 17 and 18) used to manually operate and activate lock pin 100. Recess 104 preferably opens externally through the end of flange 102*a* to receive key 300.

In one embodiment, as shown in end view FIG. 16, recess 104 may be pentagon-shaped in cross section to compliment key 300 which may have a pentagon-shaped shaft 302 in cross-section on lock-engaging end 303. It will be appreciated that numerous other suitable cross-sectional shape combinations of lock pin recesses and keys are possible without limitation so long as the lock pin may be operably engaged by the key. Internal cylindrical protrusion 105 defines an annular space 108 configured to receive lock-engaging end 303 of lock key 300. Protrusion 105 is preferably concentrically aligned with recess 104, as shown. Internal protrusion 105 mates with and is received by complimentary-shaped cylindrical recess 304 provided in lock-engaging end 303 of lock key 300 (see FIG. 18).

Figure 17:
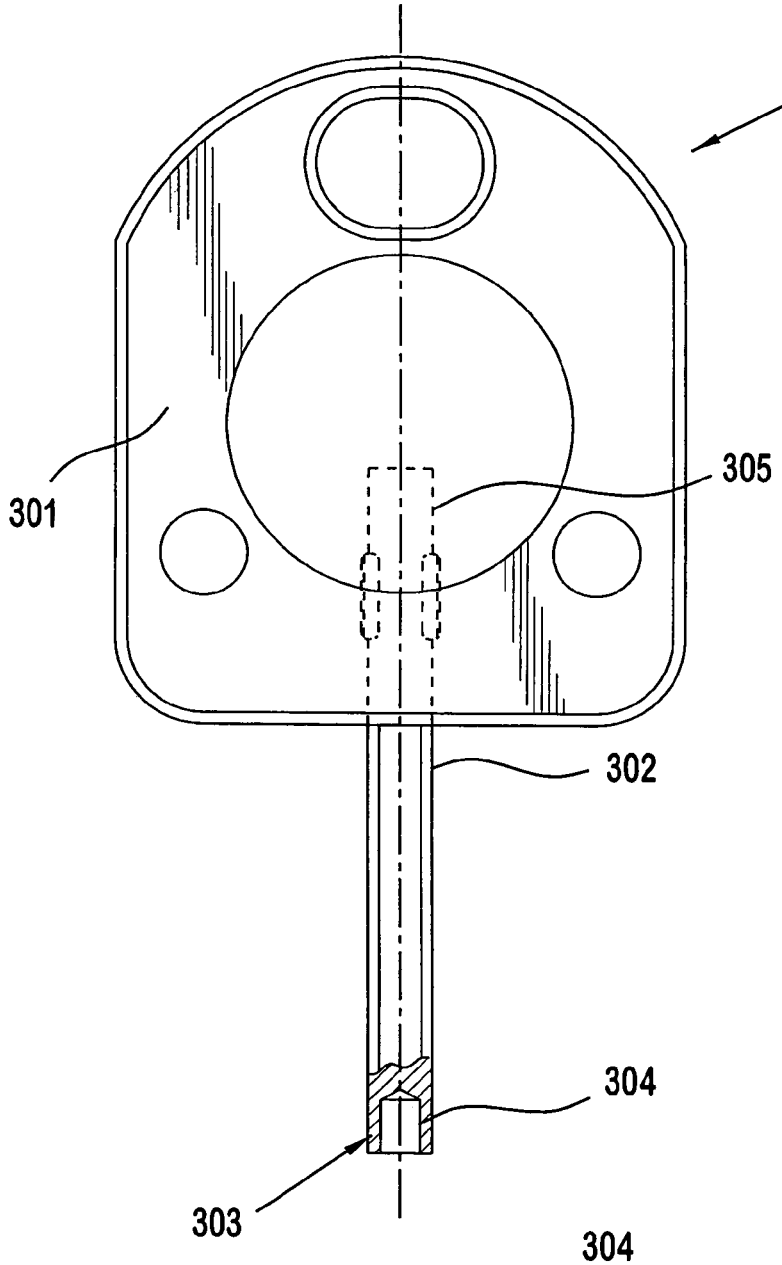
FIG. 17 is a side elevation view of a lock key useable with the pistol of FIG. 1.
Figure 18:
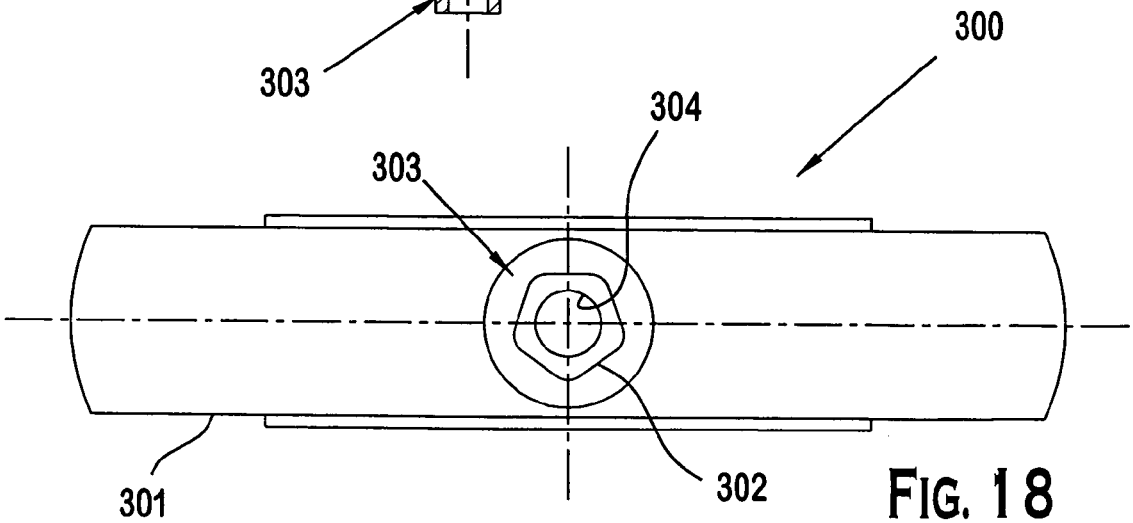
FIG. 18 is an end view of the lock key of FIG. 17.

Referring specifically to FIGS. 17-18, lock key 300, which may be used to operably engage lock pin 100 as noted above, includes a generally flattened handle 301 mounted to an elongated key shaft 302 at one end 305. At an opposite end of shaft 302 is lock engaging end 303 which preferably is configured to mate with correspondingly configured key-lock recess 104 of lock pin 100 (see FIGS. 14 & 16, and discussion above). Key 300 allows access to internal lock pin 100 so that lock pin 100 may be rotationally moved in position between the foregoing locked and unlocked positions described above.

Figure 6:
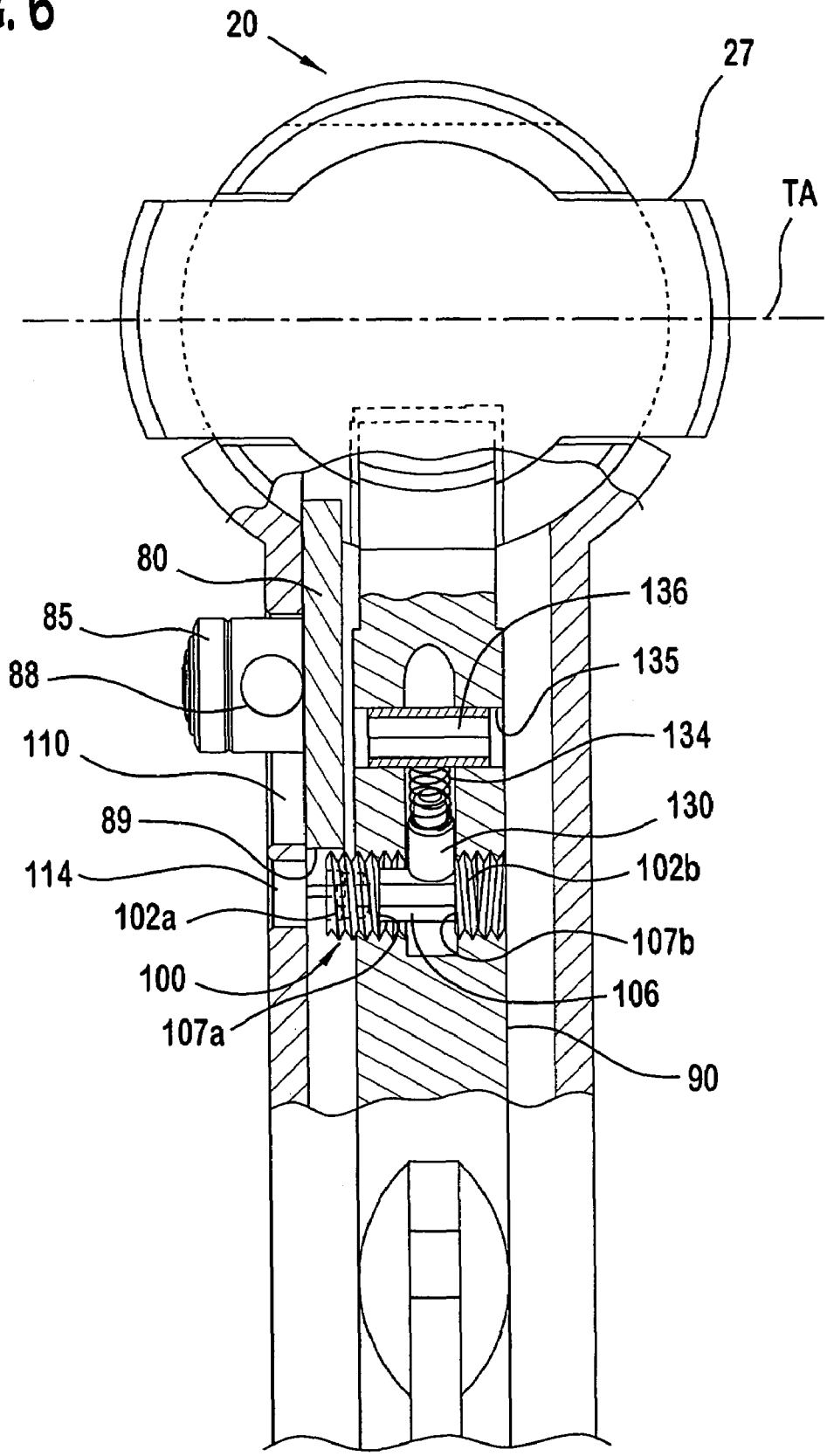
FIG. 6 is a partial rear elevation view of the pistol of FIG. 1 showing the lock pin engaged with the safety.

Lock pin 100 may be movably disposed in a housing mounted to pistol 20. In the preferred embodiment, mainspring housing 90 may serve as the housing for lock pin 100, as shown in FIGS. 5-6. Mainspring housing 90 is located in grip frame handle portion 35. Although in the preferred embodiment lock pin 100 is conveniently carried by mainspring housing 90, a separate housing for lock pin 100 may be provided as a matter of design choice.

Figure 3:
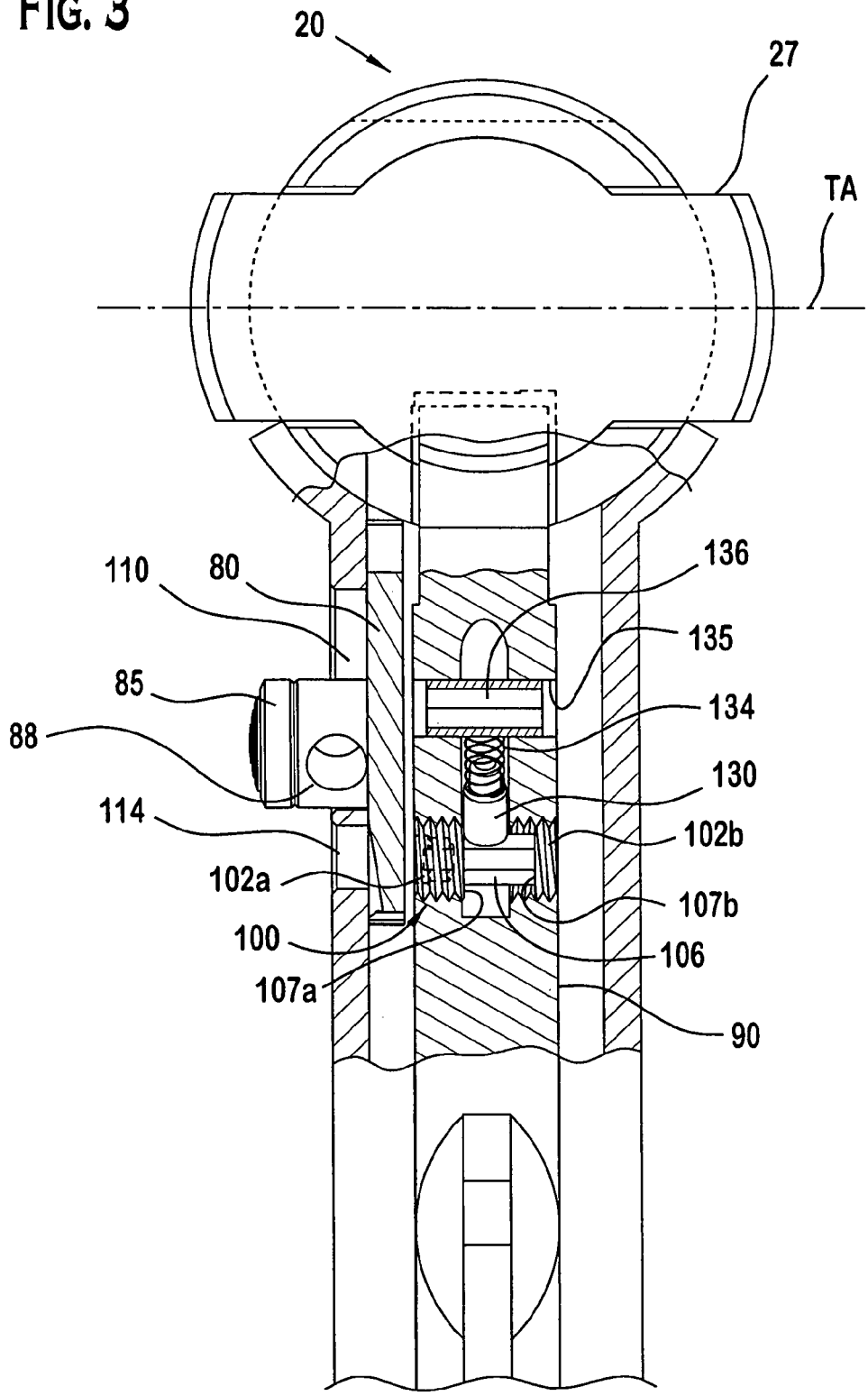
FIG. 3 is a partial rear elevation view of the pistol of FIG. 1 showing the lock pin disengaged from the safety.

With continuing reference to FIGS. 14-16, sides 103*a*, 103*b* of flanges 102*a*, 102*b*, respectively, are threaded externally to be received in complimentary internally threaded passageway 91 extending laterally through mainspring housing 90 (see FIG. 19). As best shown in FIGS. 3 and 6, flanges 102*a*, 102*b* operably and rotatably engage mainspring housing 90 via the threaded connections to provide right and left transverse or lateral movement of lock pin 100 in pistol 20 when lock pin 100 is rotationally turned by a pistol user with key 300.

As noted above, either side 103*a* or 103*b* of cylindrical flanges 102*a*, 102*b*, respectively, provide a convex lever engaging surface in the preferred embodiment which is sized and configured to mesh and interlock with locking concave surface 89 on lever 80. When meshed, these surface lock lever 80 in position and prevent its pivotal movement.

In the preferred embodiment, lock pin 100 may be moved to assume at least two transverse or lateral positions by rotating lock pin 100 in opposite directions with key 300. Lock pin 100 may be positioned in a first lateral "unlocked" position in which lever 80 is not engaged and freely movable (i.e., "ready-to-fire" position). In this "unlocked" position, lock pin 100 remains recessed in mainspring housing 90 (see FIG. 3). Lock pin 100 may be positioned in a second lateral "locked" position in which the lock pin engages and locks lever 80 in position against movement (i.e., "safe" position). In this "locked" position, lock pin 100 protrudes outwards from mainspring housing 90 and is engaged with lock lever 80 (see FIG. 6). Preferably, lock pin 100 functions to lock lever 80 in its "safe" position-in which lever 80 is positively engaged with sear 60, as described above. It should be noted that because mainspring housing 90 and lock pin 100 are preferably housed within grip frame 30, an opening 114 in grip frame 30 as shown in FIG. 13 may be provided to allow the pistol user to access lock pin 100 with key 300.

With continuing reference to FIGS. 14-16, shaft 101 of lock pin 100 may have flat surfaces 106 configured to engage a spring-loaded lock detent plunger 130 shown in FIGS. 20-21. Lock detent plunger 130, preferably cylindrical in shape, includes a preferably flat contact surface 131 on one end configured to engage shaft 101 of lock pin 100 which also preferably contains flat surfaces 106. Protruding longitudinally from an opposite end 132 to end 131 may be a stem 133 of reduced diameter to receive one end of a helical detent spring 134 (see FIGS. 5 and 20). Lock detent plunger 130 and accompanying spring 134 are slidably movable and disposed in elongate cylindrical cavity 92 within mainspring housing 90 (see FIG. 19). Cavity 92 preferably communicates with lock pin passageway 91 so that lock detent plunger 130 may operably contact shaft 101 of lock pin 100. In one embodiment, cavity 92 is oriented perpendicular to lock pin passageway 91 so that lock pin 100 makes square or perpendicular contact with shaft 101 of lock pin 100. Preferably, spring 134 biases lock detent plunger 130 into engagement with lock pin 100.

As shown in FIGS. 5 and 19, transverse hole 135 may be provided in mainspring housing 90 which communicates with detent plunger cavity 92 at a position behind detent spring 134. Shown in FIG. 5 is backup spring roll pin 136, preferably made of rolled sheet metal, which is compressed and then inserted into hole 135. Spring pin 136 expands as it is released in hole 135, and becomes press-fitted therein. Pin 136 properly tensions lock detent plunger spring 134, and allows detent plunger 130 and spring 134 to be removed and replaced if required independently of other mainspring housing 90 appurtenances.

Lock detent plunger 130 functions to prevent lock pin 100 from being threaded completely out of mainspring housing 90 by turning lock pin 100 with lock key 300. When lock pin 100 is turned with key 300, which moves lock pin 100 laterally in mainspring housing 90, plunger 130 would eventually abut the inside surfaces 107*a*, 107*b* of either flanges 102*a*, 102*b* respectively (depending on whether lock pin 100 is moving left or right). Continued lateral movement left or right is thereby prevented. Lock detent plunger 130 also prevents lock pin 100 from rotating in position and moving laterally by itself due to vibrations caused by discharging pistol 20 without a pistol user employing lock key 300. This is accomplished by flat surfaces 106 of lock pin shaft 101 engaging lock detent plunger 130, as described above.

Operation of pistol 20 and the lockable manual safety mechanism will now be described with primary reference to FIGS. 2-6. In FIG. 2, pistol 20 is shown fully enabled and in the ready-to-fire position with hammer 70 fully cocked and held in position by sear 60. The lockable manual safety mechanism is deactivated, with lever 80 in a downward position as visually evidenced by the location of knob 85 near the bottom of grip frame window 110. Lever detent plunger 130 is engaged in lower notch 112 of grip frame window 110. Hook 82 of lever 80 is not engaged with sear 60 which may pivotally move. When trigger 40 is pulled, trigger bar 50 moves forward and contacts sear 60 causing the sear to pivot forwards and release hammer 70. Hammer 70, which is spring-biased forwards, pivotally moves and strikes firing pin 26 which is pushed forward to contact a cartridge 25 which may be loaded in chamber 21. Pistol 20 is thus discharged. In semi-automatic mode, bolt 27 recoils rearward to allow the spent cartridge to be ejected from pistol 20. Bolt 27 returns forward due to the urging of the recoil spring (not shown), and loads another cartridge from magazine 28 into chamber 21 and fully recocks hammer 70 to the ready-to-fire position.

When hammer 70 is fully cocked, the lockable manual safety mechanism may be activated to disable pistol 20 from being discharge. This is accomplished by the pistol user moving lever 80 upwards with knob 85. This action engages lever 80 with sear 60, thereby fully arresting and preventing the movement of sear 60 which remains engaged with hammer 70. Hook 82 of lever 80 engages sear 60, with a portion of sear 60 becoming captured in lever recess 83, as shown in FIG. 4. Lever knob 85 is located near the top of grip frame window 110 with lever detent plunger 130 engaged in upper notch 111 of grip frame window 110. As shown in FIG. 4, pistol 20 is now in the "safe" position such that pulling trigger 40 will not move sear 60 and release hammer 70 to discharge the pistol.

In both the "ready-to-fire" and "safe" positions just described, lock pin 100 is in the "unlocked" position being positioned and recessed inside mainspring housing 90 (see FIG. 3). Accordingly, lock pin 100 preferably cannot operably engage lever 80 in this recessed position.

The pistol user may now use the safety lock feature of the preferred embodiment to lock lever 80 and pistol 20 in the foregoing "safe" position. Using lock key 300, the user may turn and rotate lock pin 100 to laterally move lock pin 100 from its "unlocked" position to its "locked" position in which at least a portion of lock pin 100 protrudes outwards from mainspring housing 90. As shown in FIG. 6, lock pin flange 102*a* moves laterally outwards and meshes with locking concave surface 89 of lever 80 by an amount sufficient to lock and prevent lever 80 from being manually moved to the "ready-to-fire" position with knob 85. Lever 80 cannot be moved without first using key 300 to rotate and return lock pin 100 to the "unlocked" position, thereby disengaging the lock pin from the lever. Lever 80 may now function in the manner described above being movable by the pistol user between the "safe" and "ready-to-fire" positions.

Another advantage of the safety lock feature is that in the "locked" position of lock pin 100, normal disassembly of pistol 20 is prevented. This is due to hammer 70 being locked into a cocked position so that full mainspring 78 pressure is applied to mainspring housing latch 137 (see FIG. 2) and cannot be relieved. Mainspring housing latch 137, which must ordinarily be pivoted outwards to remove mainspring 78 from grip frame 30, cannot be moved under this pressure without undue force. In addition, with lock pin 100 in the "locked" position and protruding outwards from the left side of mainspring housing 90 and engaged with safety 80, the mainspring housing cannot be swung out the rear of grip frame 30 without undue or excessive force due to the interference between the safety and lock pin.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific, environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A pistol with lockable manual safety mechanism lock comprising:

a frame;

a hammer pivotally mounted to the frame;

a sear engageable with the hammer, the sear operable to hold the hammer in a cocked position and further to release the hammer from the cocked position to discharge the pistol;

a manual safety movable into and out of engagement with the sear, the safety when engaged with the sear to prevent the sear from moving and releasing the hammer while held in the cocked position by the sear; and a locking member movable from an unlocked position in which the safety is freely movable, to a locked position in which the locking member engages the safety so that the safety cannot freely move and is locked into engagement with the sear while the hammer is held in the cocked position by the sear;

wherein the safety further comprises a concave locking surface and the locking member further comprises a complimentary configured meshing convex engaging surface, the locking member surface meshing with the engaging surface when the locking member is in the locked position.

2. The pistol of claim 1, further comprising a housing to carry the locking member, the locking member movable in the housing and recessed within the housing when in the unlocked position, and the locking member protruding outward from the housing to engage the safety when in the locked position.

3. The pistol of claim 2, wherein the locking member is rotatably carried by the housing and movable in a lateral direction between the locked and unlocked positions.

4. A pistol with lockable manual safety mechanism lock comprising:

a frame;

a longitudinally-extending barrel carried by the frame;

a hammer pivotally mounted to the frame;

a sear engageable with the hammer, the sear operable to hold the hammer in a cocked position and further to release the hammer from the cocked position to discharge the pistol;

a manual safety movable into and out of engagement with the sear, the safety when engaged with the sear to prevent the sear from moving and releasing the hammer while held in the cocked position by the sear;

a locking member movable from an unlocked position in which the safety is freely movable, to a locked position in which the locking member engages the safety so that the safety cannot freely move and is locked into engagement with the sear while the hammer is held in the cocked position by the sear; and a housing to carry the locking member, to locking member movable in the housing and recessed within the housing when in the locked position, and the locking member protruding outward from the housing to engage the safety when in the locked position, the locking member rotatably carried by the housing and movable in a lateral direction between the locked and unlocked positions, the locking member having external threads and the housing having an internally-threaded passageway to rotatably receive the locking member.

5. The pistol of claim 4, further comprising the pistol including a longitudinally-extending barrel coupled to the frame, wherein the threaded passageway is oriented transversely to the barrel in the pistol.

6. A pistol with lockable manual safety mechanism lock comprising:

a frame;

a hammer pivotally mounted to the frame;

a sear engageable with the hammer, the sear operable to bold the hammer in a cocked position and further to release the hammer from the cocked position to discharge the pistol;

a manual safety movable into and out of engagement with the sear, the safety when engaged with the sear to prevent the sear from moving and releasing the hammer while held in the cocked position by the sear;

a locking member movable from an unlocked position in which the safety is freely movable, to a locked position in which the locking member engages the safety so that the safety cannot freely move and is locked into engagement with the sear while the hammer is held in the cocked position by the sear; and a housing to carry the locking member, the locking member movable in the housing and recessed within the housing when in the locked position, and the locking member protruding outward from the housing to engage the safety when in the locked position, the locking member rotatably carried by the housing and movable in a lateral direction between the locked and unlocked positions; and a spring-loaded detent plunger, the locking member having a shaft configured to engage the plunger, the plunger biased toward and engaging the shaft so that the locking member resists rotation unless manually rotated by a pistol user.

7. The pistol of claim 6, wherein the shaft includes at least one flat surface to engage a complimentary flat surface on the detent plunger.

8. The pistol of claim 6, wherein the locking member is operated with a key by a user to move the locking member between the locked and unlocked positions.

9. A pistol with lockable manual safety mechanism lock comprising:

a frame;

a hammer pivotally mounted to the frame;

a sear engageable with the hammer and having a protrusion, the sear operable to hold the hammer in a cocked position and further to release the hammer from the cocked position to discharge the pistol;

a safety lever movable into and out of engagement with the sear, the lever having a hook to engage the sear protrusion and a locking surface, the lever when engaged with the sear preventing the sear from moving and releasing the hammer while held in the cocked position by the sear; and a rotatable lock pin having an engaging surface, the lock pin movable in a lateral direction by a pistol user to mesh the engaging surface with the locking surface of the lever;

wherein the lever may be locked into engagement with the sear while the hammer is held in the cocked position by the sear to prevent the sear from releasing the hammer;

wherein the locking surface of the lever is concave and the engaging surface of the lock pin is convex.

10. The pistol of claim 9, wherein the lock pin further comprises a shaft having a diameter and two ends, and a first radially-protruding cylindrical flange disposed on one end of the shall, the flange having a diameter larger than the diameter of the shaft, the flange including the engaging surface disposed thereon.

11. The pistol of claim 10, further comprising a housing having an internally threaded passageway and the flange having external threads to engage the threaded passageway, the lock pin movable from a first lateral position in which the lock pin is recessed within the housing to a second lateral position in which the lock pin protrudes outward from the housing to engage the safety.

12. The pistol of claim 11, further comprising a detent plunger biased into contact with the lock pin shaft, and the lock pin further comprising a second radially-protruding cylindrical flange disposed on the other end of the shaft and spaced apart from the first flange, the plunger trapped between the two flanges to prevent the lock pin from being laterally unthreaded and removed from the housing without disassembling the pistol.

13. A pistol with lockable manual safety mechanism lock comprising:

a frame;

a hammer pivotally mounted to the frame;

a sear engageable with the hammer and having a protrusion, the sear operable to hold the hammer in a cocked position and further to release the hammer from the cocked position to discharge the pistol;

a lever movable into and out of engagement with the sear, the lever having a hook to engage the sear protrusion and a locking surface, the lever when engaged with the sear preventing the sear from moving and releasing the hammer while held in the cocked position by the sear; and a rotatable lock pin having an engaging surface, the lock pin movable in a lateral direction by a pistol user to mesh the engaging surface with the locking surface of the lever;

wherein the lever may be locked into engagement with the sear while the hammer is held in the cocked position by the sear to prevent the sear from releasing the hammer;

wherein the lock pin is laterally oriented and threadably disposed in the frame such that rotating the lock pin in opposite directions laterally moves the lock pin with respect to the frame both into and out of engagement with the lever.

14. The pistol of claim 13, further comprising a key having an end configured to engage a complimentary-configured recess in the lock pin, the key useable by the pistol user to rotate the lock pin and lock the lever into engagement with the sear.

15. The pistol of claim 13, further comprising a key configured to engage the lock pin and useable by a pistol user to move the lock pin.

* * * * *

UNITED STATES PATENT AND TRADEMARK OFFICE

CERTIFICATE OF CORRECTION

PATENT NO. : 7,234,261 B2
APPLICATION NO. : 10/825510
DATED : June 26, 2007
INVENTOR(S) : James McGarry It is certified that error appears in the above-identified patent and that said Letters Patent is hereby corrected as shown below:

Column 13, line 41, change “to” before “locking member” to --the--; line 61, change “bold” to --hold--.

Signed and Sealed this

Twenty-first Day of August, 2007

JON W. DUDAS
*Director of the United States Patent and Trademark Office*